US006692281B1

(12) United States Patent
McClinton et al.

(10) Patent No.: US 6,692,281 B1
(45) Date of Patent: Feb. 17, 2004

(54) SOCKET COVER TAB FOR ENGAGING CAM FEATURES

(75) Inventors: Jeffrey B. McClinton, Harrisburg, PA (US); Richard N. Whyne, Camp Hill, PA (US); Darrell L. Wertz, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/308,436

(22) Filed: Dec. 3, 2002

(51) Int. Cl.[7] ..... H01R 33/02
(52) U.S. Cl. ..... 439/342; 439/262
(58) Field of Search ..... 439/342, 496, 439/372, 370, 352, 262, 15, 492, 495, 493, 264, 268

(56) References Cited

U.S. PATENT DOCUMENTS 6,338,639 B1 * 1/2002 Trout et al. ..... 439/342

* cited by examiner

*Primary Examiner*—P. Austin Bradley
*Assistant Examiner*—Phuongchi Nguyen

(57) ABSTRACT

An electrical socket assembly having a socket cover slidably mounted to a socket base over a range of motion. The socket assembly also includes a drive plate mounted to a cam portion of the socket cover. The drive plate and socket cover have range limit elements that engage one another to limit opposite ends of the range of motion. The socket assembly includes a cam shaft that engages the socket cover, drive plate, and socket base. The cam shaft is rotatable across a range of motion between an unlocked position and a locked position to slide the socket cover with respect to the socket base.

18 Claims, 4 Drawing Sheets

SOCKET COVER TAB FOR ENGAGING CAM FEATURES

BACKGROUND OF THE INVENTION

The present invention generally relates to an electrical socket assembly. More particularly, the present invention relates to and electrical socket assembly with tabs in the socket cover that absorb forces delivered by a rotating cam.

Many large electronic devices, such as computers, use sockets to connect different electronic components. For example, pin grid array (PGA) sockets are used to connect electronic packages, such as processors, to printed circuit boards. PGA sockets facilitate electrical communication between a large number of pins on the processor and contacts on the circuit board. PGA sockets may utilize a plastic socket cover that is slidably movable on a plastic socket base between open and closed positions. A metal cam shaft is situated in a channel on the socket cover and extends through the socket cover and socket base. The cam shaft is rotated to actuate the sliding movement. The cam shaft has a rectangular stop extending therefrom that rotates along a semi-circle within the channel between opposite blocking features formed with the socket cover. When the stop engages a first blocking feature, the socket cover is in the open position, and when the stop engages the second blocking feature, the socket cover is in the closed position.

The cover has an array of pin holes configured to match an array of pins on the processor. Similarly, the socket base has an array of pin receiving chambers configured to accept the array of pins on the processor and connected to contact pads on the circuit board. The processor is mated to the socket by first placing the processor such that its pins slide into the pin holes of the socket cover. With the socket cover in the open position, the processor pins pass through the pin holes of the socket cover into the pin receiving chambers of the socket base, but are not electrically connected to the pin receiving chambers of the socket base. The cam shaft is rotated to slide the socket cover to the closed position which causes the processor pins to electrically connect to contacts in the pin receiving chambers in the socket base.

Hence, conventional sockets suffer from several drawbacks. When the cam shaft is rotated in the channel and engages the plastic blocking features, the cam shaft applies a torque force to the blocking features. However, if the cam shaft applies too much torque, then the cam shaft can cause the plastic blocking features and the surrounding plastic of the socket cover to strain and crack under the force. Many socket applications require more substantial force to effectively close the socket cover and thus conventional sockets cannot be used in such applications.

A need exists for an electrical socket that addresses the above noted problems and others experienced heretofore.

BRIEF SUMMARY OF THE INVENTION

Certain embodiments include an electrical socket assembly having a socket cover slidably mounted to a socket base over a range of motion. The socket assembly also includes a drive plate mounted to a cam portion of the socket cover. The drive plate and socket cover have range limit elements that engage one another to limit opposite ends of the range of motion. The socket assembly includes a cam shaft that engages the socket cover, drive plate, and socket base. The cam shaft is rotatable across a range of motion between an unlocked position and a locked position to slide the socket cover with respect to the socket base.

Figure 1:
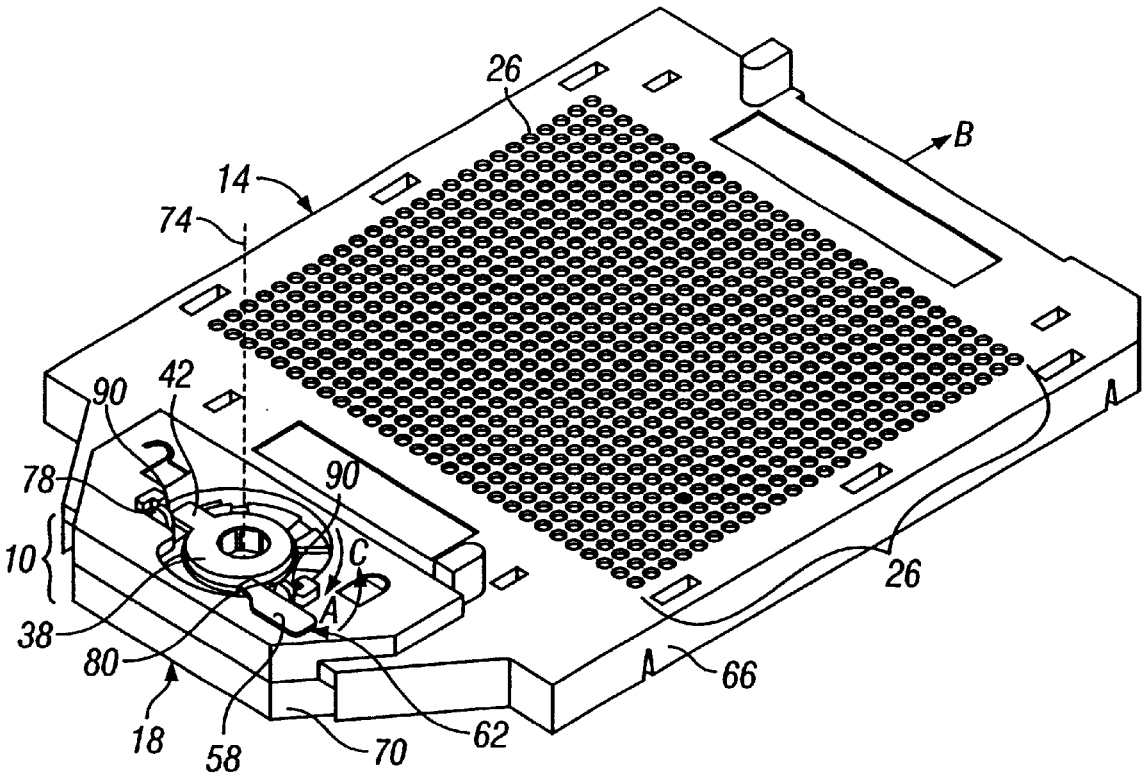
FIG. 1 illustrates a top isometric view of a socket assembly formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 2:
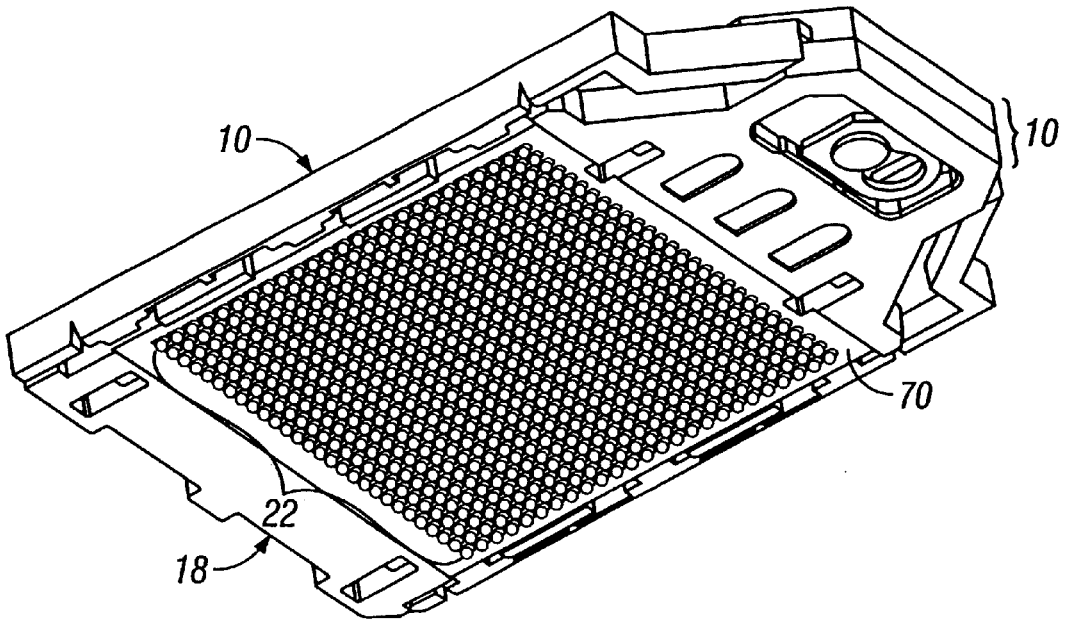
FIG. 2 illustrates a bottom isometric view of the socket assembly of FIG. 1.

FIGS. 1 and 2 illustrate isometric views of a socket assembly 10 formed according to an embodiment of the present invention. The socket assembly 10 includes an insulated socket cover 14 slidably mounted to an insulated socket base 18. The socket base 18 has a body 70 that carries an array of receptacle contacts 22 (FIG. 1) extending therethrough. The socket cover 14 has an array of pin holes 26 (FIG. 2) that are aligned to be positioned above the array of receptacle contacts 22. In operation, the socket assembly 10 is connected to an electronic component such as a circuit board (not shown) by soldering the receptacle contacts 22 to contact pads or traces on the circuit board. A processor (not shown) having an array of pins is then positioned on top of the socket cover 14 such that the pin holes 26 receive the pins. The pins of the processor extend into, and engage, the receptacle contacts 22 in the body 70 of the socket base 18.

Figure 3:
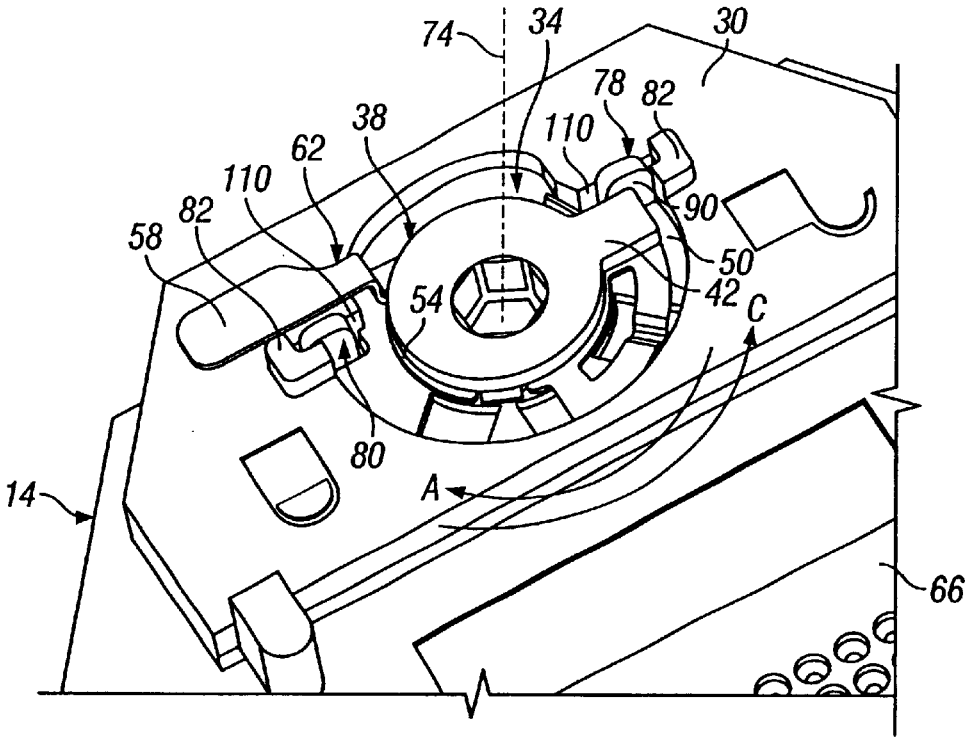
FIG. 3 illustrates a partial top isometric view of a socket cover formed according to an embodiment of the present invention.

FIG. 3 illustrates a partial isometric view of the socket cover 14. The socket cover 14 has a generally rectangular body 66 with a cam portion 30 extending from an end thereof. The cam portion 30 has a semicircular channel 34 that receives an indicator 62 and a cylindrical metal cam shaft 38. The cam shaft 38 has a rectangular stop 42 formed with, and extending out from, a peripheral edge of the cam shaft 38. The indicator 62 includes a circular ring 54 connected to a handle 58. The ring 54 rests on a top surface 50 of the channel 34. The cam shaft 38 extends through the ring 54 into the body 66 of the socket cover 14 and the body 70 of the socket base 18 (FIGS. 1 and 2). Arched first and second tabs 78 and 80 extend upward through the top surface 50 of the channel 34 at opposite ends thereof. The first and second tabs 78 and 80 are received between L-shaped guide posts 82 extending from out of the cam portion 30 and side walls 110 extending along the channel 34. The first and second tabs 78 and 80 have stop engagement sides 90. As the stop 42 engages the stop engagement side 90 of the first tab 78, the handle 58 of the indicator 62 is proximate the second tab 80.

The socket assembly 10 is shown in FIGS. 1 and 3 in an unlocked position where the socket cover 14 and socket body 18 are aligned such that the pins of the processor freely slide into and, are not bound in, the pin holes 26 of the socket cover 14. An operator is able to determine that the socket assembly 10 is in the unlocked position because the stop 42 engages the stop engagement side 90 of the first tab 78. As the handle 58 is rotated in the direction of arrow A about a rotational axis 74, the cam shaft 38 is rotated in the direction of arrow A and engages the body 66 of the socket cover 14 and the body 70 (FIG. 1) of the socket base 18. The cam shaft 38 pushes the body 66 of the socket cover 14 in the direction of arrow B with respect to the body 70 of the socket base 18. The relative horizontal shifting between the socket cover 14 and the socket base 18 causes the pin holes 26 to shift out of alignment with the receptacle contacts 22 (FIG. 2) and bind the pins within the socket cover 14. When the handle 58 has been rotated in the direction of arrow A to the point where the stop 42 is resisted by the stop engagement side 90 of the second tab 80 and the handle 58 is proximate the first tab 78, the pins are fully bound in the pin holes 26. Thus, the position of the stop 42 indicates to an operator that the socket assembly 10 is in a locked position and electrically connects the processor to the circuit board. Alternatively, to release the pins from the pin holes 26, the indicator 62 is rotated about the rotational axis 74 in the direction of arrow C from the locked position to the unlocked position.

Figure 7:
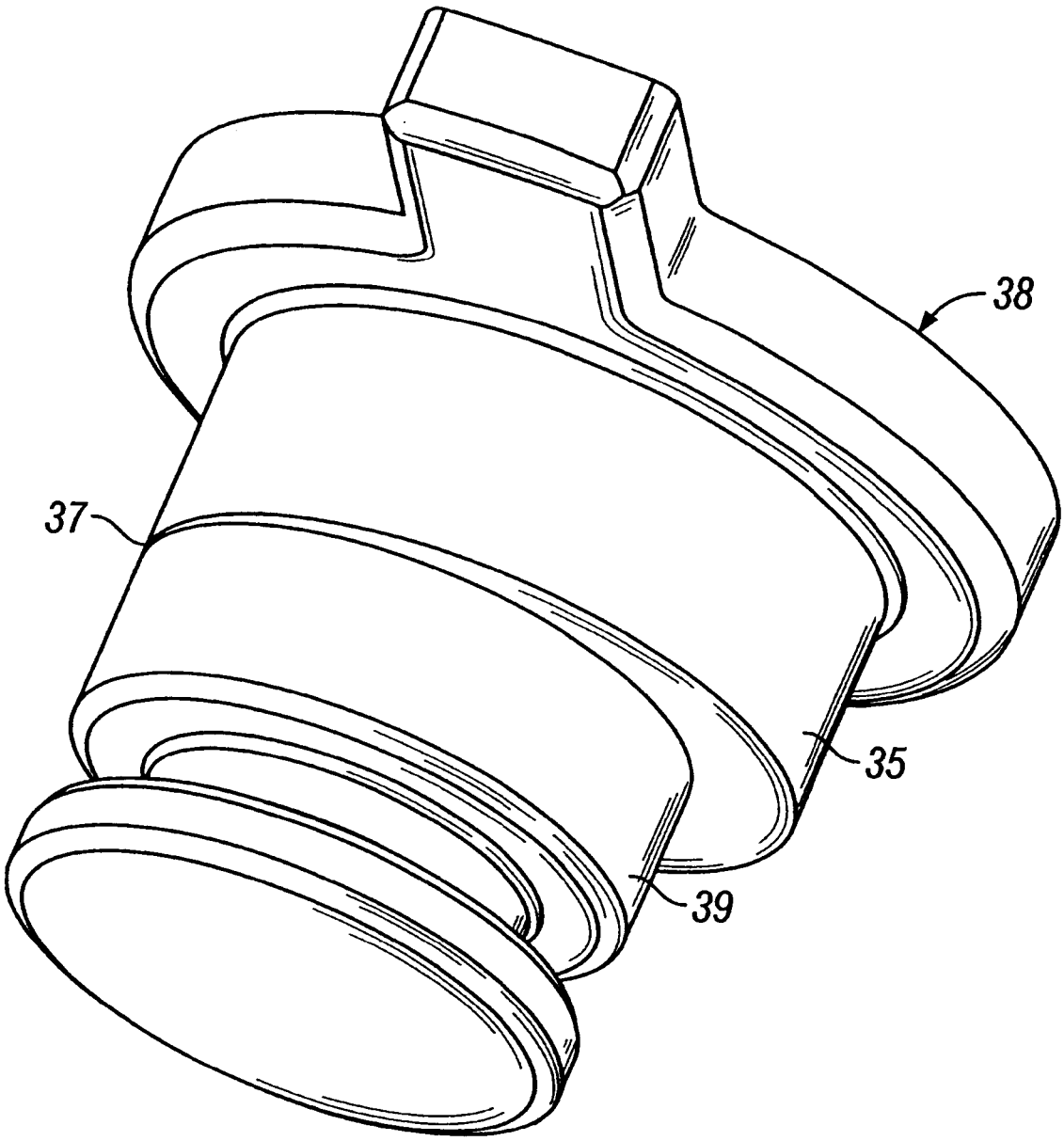
FIG. 7 illustrates an isometric view of a cam shaft formed according to an embodiment of the present invention.

FIG. 7 illustrates an isometric view of the cam shaft 38 formed according to an embodiment of the present invention. The cam shaft 38 includes cylindrical upper and lower portions 35 and 39. The upper portion 35 has a larger radius than the lower portion 39. The upper portion 35 overlaps the lower portion 39 along the perimeter of the lower portion 39 except where the upper and lower portions 35 and 39 share a common wall 37 at a point in their respective perimeters. The upper portion 35 is received within the socket cover 14 (FIGS. 1 and 2) and the lower portion 39 is received within the socket base 18 (FIGS. 1 and 2).

Figure 4:
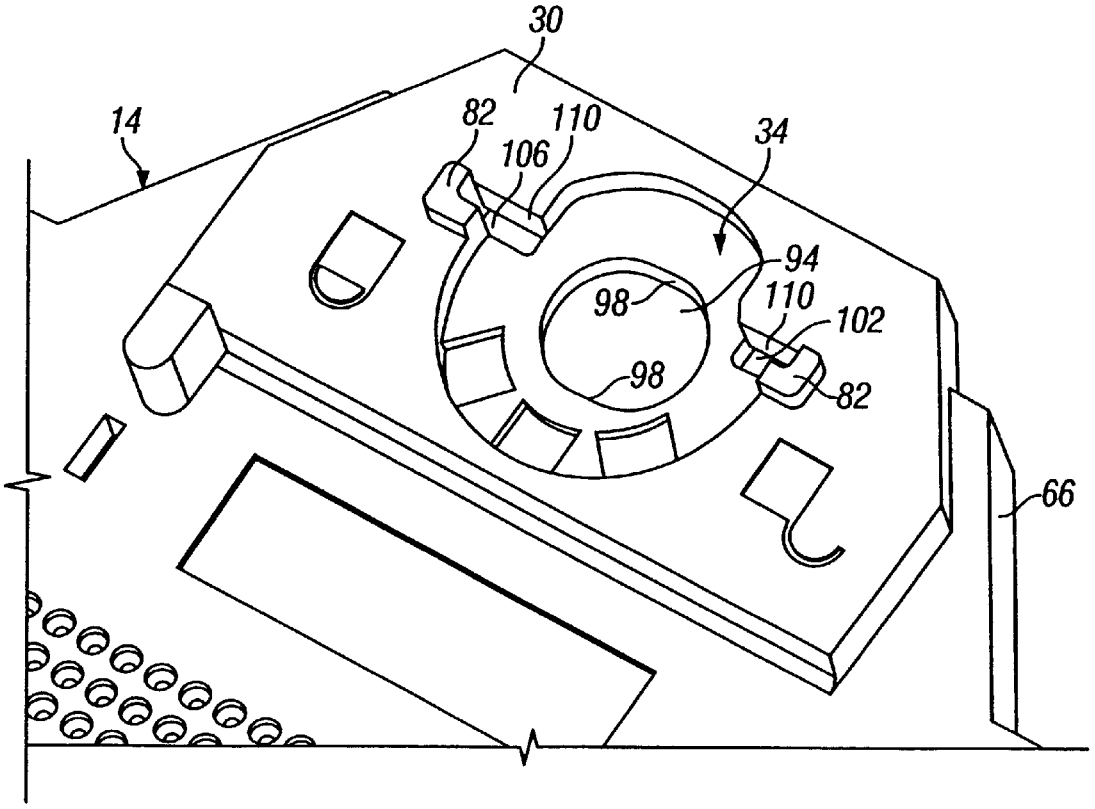
FIG. 4 illustrates a partial top isometric view of a socket cover formed according to an embodiment of the present invention.

FIG. 4 illustrates a partial top isometric view of the socket cover 14. The socket cover 14 may be made of plastic. The cam portion 30 is shown with the cam shaft 38, indicator 62, and first and second tabs 78 and 80 removed (FIG. 1). The channel 34 includes an oval cam hole 94 that receives the upper portion 35 (FIG. 7) of the cam shaft 38. Because the upper portion 35 is circular, the cam shaft 38 only engages the body 66 of the socket cover 14 at two segments 98 defining the narrowest portion of the cam hole 94. During rotation, the cam shaft 38 thus applies torque forces to the plastic body 66 of the socket cover 14 at the two segments 98 that can cause the body 66 to strain and crack along the cam portion 30. The channel 34 also includes first and second slots 102 and 106 located between the guide posts 82 and the side walls 110 to receive the first and second tabs 78 and 80 (FIG. 3), respectively.

Figure 5:
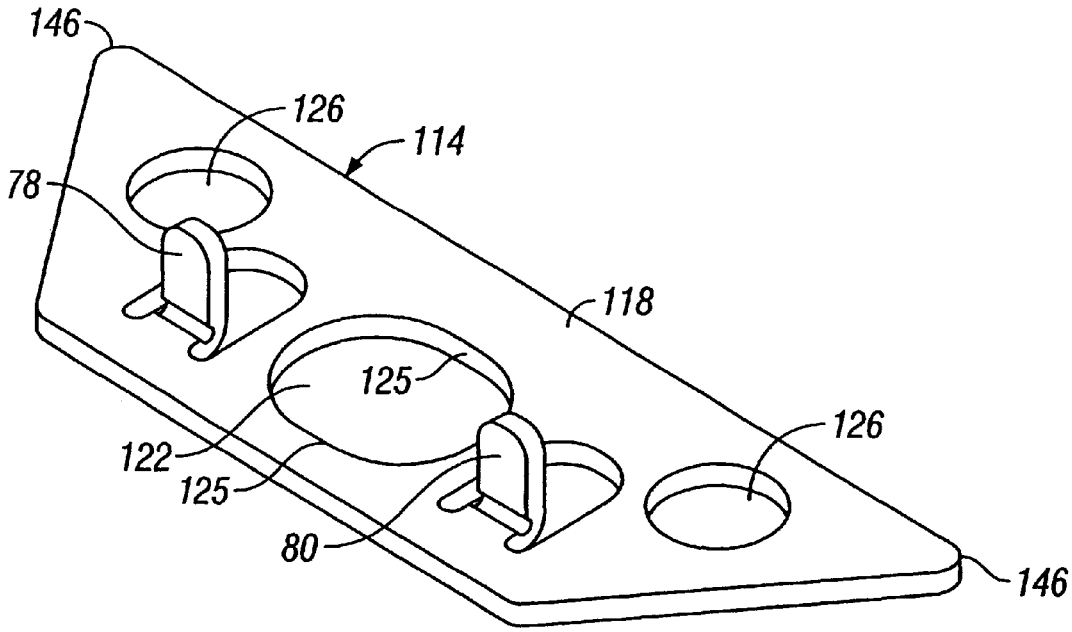
FIG. 5 illustrates an isometric view of a drive plate formed according to an embodiment of the present invention.

FIG. 5 illustrates an isometric view of a drive plate 114 formed according to an embodiment of the present invention. The drive plate 114 may be made of metal and is rhomboid or trapezoidal in shape, but may be circular, rectangular, triangular, square, hexagonal, or some other shape. The drive plate 114 is configured to be received within the cam portion 30 of the socket cover 14 of FIGS. 1–4. The first and second tabs 78 and 80 are formed with, and extend upward perpendicularly from, a top surface 118 of the drive plate 114. The first and second tabs 78 and 80 are located on opposite sides of a cam hole 122. The oval cam hole 122 that is aligned with the cam hole 94 (FIG. 4) of the socket cover 14 to receive the upper portion 35 (FIG. 7) of the cam shaft 38 (FIGS. 1–3). Because the upper portion 35 is circular, the cam shaft 38 only engages the drive plate 114 at two segments 125 defining the narrowest portion of the cam hole 122. The drive plate 114 also includes circular post holes 126 that receive posts 130 (FIG. 6) extending from the socket cover 14. The drive plate 114 strengthens the cam portion 34 (FIG. 4) around the cam hole 94 (FIG. 4) and absorbs the torque forces at the two segments 125 which receive posts 130 (FIG. 6) formed on the socket cover 14.

Figure 6:
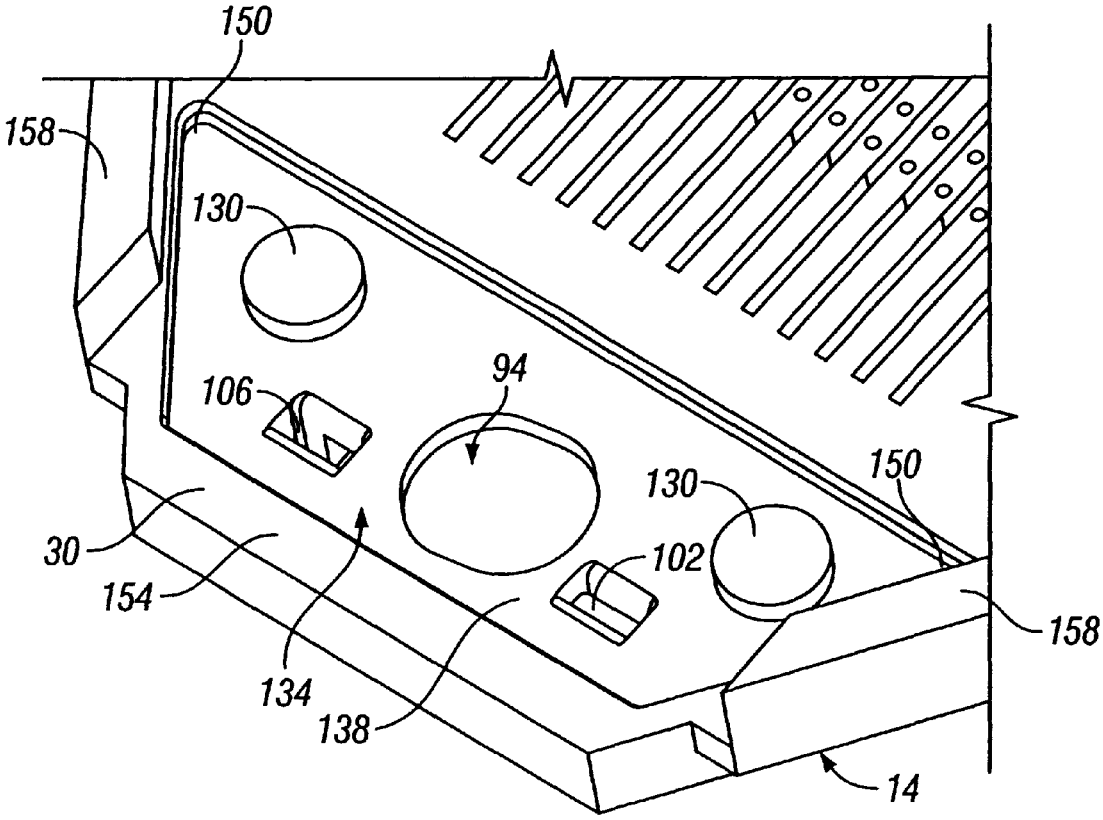
FIG. 6 illustrates a partial bottom isometric view of a socket cover formed according to embodiment of the present invention.

FIG. 6 illustrates a partial bottom isometric view of the socket cover 14. The cam portion 30 includes a recessed area 134. The posts 130 extend out from a bottom surface 138 of the recessed area 134, and the first and second slots 102 and 106 and the cam hole 94 extend through the recessed area 134. The recessed area 134 is rhomboid in shape and sized to receive the drive plate 114 of FIG. 5. The recessed area 134 is partially defined by an end wall 154 of the cam portion 30 and has angled comers 150 extending along side walls 158 of the cam portion 30.

During assembly, the drive plate 114 (FIG. 5) is press fitted into the recessed area 134 such that the top surface 118 (FIG. 5) of the drive plate 114 is pressed against the bottom surface 138, the posts 130 are received in the post holes 126 (FIG. 5) and the first and second tabs 78 and 80 (FIG. 5) are received within the first and second slots 102 and 106. Angled corners 146 (FIG. 5) of the drive plate 114 are tightly fit into corresponding angled comers 150 of the recessed area 134. The cam shaft 38 (FIG. 3) is then positioned in the aligned cam holes 94 and 122 (FIG. 5) of the socket cover 14 and drive plate 114, respectively. The upper portion 35 (FIG. 7) of the cam shaft 38 engages the socket cover 14 and the drive plate 114 and the lower portion 39 (FIG. 7) of the cam shaft 38 engages the socket base 18.

In operation, as the cam shaft 38 (FIG. 8) is rotated, the larger-radiused upper portion 35 (FIG. 8) engages the drive plate 114 (FIG. 5) and the socket cover 14 and moves the drive plate 114 and the socket cover 14 relative to the socket base 18 (FIG. 1) as the lower portion 39 (FIG. 8) of the cam shaft 38 rotates within the socket base 18. The forces created by the rotating cam shaft 38 are absorbed by, and distributed through, the drive plate 114 in order that less force is applied to the plastic cam portion 30. Therefore, the drive plate 114 helps prevent the cam shaft 38 from straining or cracking the socket cover 14 at the cam portion 30. Additionally, the posts 130 prevent the drive plate 114 from being partially rotated or twisted within the recessed area 134 and thus reduce the amount of force being distributed by the plate against the end wall 154 and the corners 150 along the side walls 158.

Returning to FIG. 3, the torque forces delivered by the stop 42 of the cam shaft 38 to the plastic side walls 110 as the cam shaft 38 is rotated between the locked and unlocked positions over time would cause the side walls 110 to strain or crack. However, the first and second tabs 78 and 80 resist and absorb the torque forces of the cam shaft 38 as the cam shaft 38 is rotated within the channel 34 in the directions of arrows A and C. The torque forces are then distributed throughout the drive plate 114 (FIG. 5) in the recessed area 134 (FIG. 6). The first and second tabs 78 and 80 can easily withstand and absorb a strong torque force, for example, 10 in/lbs, without straining or cracking. Therefore, the first and second tabs 78 and 80 strengthen the cam portion 30 of the socket cover 14 and generally extend the life of the socket cover 14. Additionally, the first and second tabs 78 and 80 serve as position assurance indicators to an operator to let the operator know whether the pins are fully locked or unlocked within the pin holes 26 of the socket cover 14.

In an alternative embodiment, the first and second tabs 78 and 80 may be formed with the socket cover 14 and extend through slots in the drive plate 114. In another embodiment, the drive plate 114 may be positioned on top of the cam portion 30 and receive the first and second tabs 78 and 80 through the slots. Alternatively, the drive plate 114 may be positioned on top of the cam portion 30 and have tabs extending into slots in the socket cover 14 and tabs that engage the cam shaft 38.

In another alternative embodiment, the posts 130 may be located in different positions within the recessed area 134 and corresponding post holes 126 may be located in different positions in the drive plate 114. For example, the posts 130 may be located closer to each other alongside the cam hole 94 and the corresponding post holes 126 located closer to each other alongside the cam hole 122.

In another alternative embodiment, the recessed area 134 may have more than two posts 130 received in corresponding post holes 126 in the drive plate 114. For example, the recessed area 134 may have four smaller posts 130 situated about the cam hole 94. Similarly, the drive plate 114 would have corresponding smaller post holes 126 situated about the cam hole 122 to receive the posts 130.

In another alternative embodiment, the recessed area 134 and the corresponding drive plate 114 may have any variety of different shapes and sizes. For example, the recessed area 134 and drive plate 114 could have square, triangular, rounded, rhomboid, hexagonal, star-shaped or any other geometric or amorphous, non-symmetric shapes. Additionally, the recessed area 134 and the drive plate 114 can vary in sizes depending on the additional strength required by the drive plate 114 and the size and number of posts 130 needed to support the drive plate 114. Different sized and shaped drive plates 114 and recessed areas 134 may be appropriate to limit force concentrations on particular points along the recessed area 134.

In another alternative embodiment, the posts 130 and the corresponding post holes 126 may be any variety of size and shape. For example, the posts 130 and post holes 126 may be square, rectangular, triangular, star-shaped, hexagonal, or any other geometric or amorphous, non-symmetric shape. Different sized and shaped posts 130 may be appropriate for different torque requirements and socket cover 14 uses.

In another alternative embodiment, the posts 130 extend from the drive plate 114 and the post holes 126 are located in the recessed area 134. Thus, the drive plate 114 is fitted into the recessed area 134 with the posts 130 extending into the socket cover 14. Such an embodiment may be used where stronger posts 130 formed of metal or a similarly strong and durable substance are needed to withstand torque forces applied to the drive plate 114.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical socket assembly comprising:

a socket cover slidably mounted to a socket base;

a drive plate directly mounted to said socket cover, said drive plate and socket cover having range limit elements; and a cam shaft engaging said socket cover, drive plate, and socket base and being rotatable across a range of motion to slide said socket cover with respect to said socket base, said range limit elements engaging one another to limit opposite ends of said range of motion to an unlocked position and a locked position.

2. The electrical socket assembly of claim 1, wherein said range limit elements include a tab formed perpendicularly with said drive plate, said drive plate being press fitted in a recessed area in said socket cover such that said tab extends through a slot in said socket cover.

3. The electrical socket assembly of claim 1, wherein said cam shaft rotates within a channel formed through said cam portion, said range limit elements including tabs on said drive plate located on opposite sides of said channel, said cam shaft including stops located such that when one of said stops engages one of said tabs, said socket cover is in said unlocked position and when another of said stops engages another of said tabs, said socket cover is in said locked position.

4. The electrical socket assembly of claim 1, wherein said range limit elements include a tab extending from said drive plate, said cam shaft imparting a force on said tab when said cam shaft engages said tab, said force being distributed across said drive plate.

5. The electrical socket assembly of claim 1, wherein said drive plate further includes post holes that receive posts formed on said socket cover, said posts and post holes preventing said drive plate from moving relative to said socket cover.

6. The electrical socket assembly of claim 1, wherein said drive plate tightly fits into a recessed area in said socket cover.

7. The electrical socket assembly of claim 1, wherein said drive plate fits within a cam portion of said socket cover, said cam portion being formed integrally with said socket cover.

8. An electrical socket assembly comprising:

a socket cover slidably mounted to a socket base:

a drive plate mounted to a cam portion of said socket cover, said drive plate and socket cover having range limit elements; and a cam shaft engaging said socket cover, drive plate, and socket base and being rotatable across a range of motion to slide said socket cover with respect to said socket base, said range limit elements engaging one another to limit opposite ends of said range of motion to an unlocked position and a locked position, wherein said range limit elements comprise tabs and slots formed in said drive plate and said socket cover, said tabs being slidable along said slots and abutting against ends of said slots to define said opposite ends of said range of motion.

9. An electrical socket assembly comprising:

a socket cover slidably mounted to a socket base, a drive plate mounted to a cam portion of said socket cover, said drive plate and socket cover having range limit elements, and a cam shaft engaging said socket cover, drive plate, and socket base and being rotatable across a range of motion to slide said socket cover with respect to said socket base, said range limit elements engaging one another to limit opposite ends of said range of motion to an unlocked position and a locked position, wherein said cam shaft rotates within a channel in said cam portion, said range limit elements including a tab extending through a slot alongside a side wall of said channel such that said tab prevents a stop of said cam shaft from engaging said side wall.

10. An electrical socket assembly comprising:

a socket cover slidably mounted to a socket base;

said socket cover including a cam portion that carries a cam shaft in a channel and a drive plate in a recessed area, said cam shaft extending through said socket cover and said drive plate and being rotatable across a range of motion; and said drive plate and said socket cover having range limit elements that engage one another to limit opposite ends of said range of motion, wherein said range limit elements comprise tabs and slots formed in said drive plate and said socket cover, said tabs being slidable along said slots and abutting against ends of said slots to define said opposite ends of said range of motion.

11. An electrical socket assembly comprising:

a socket cover slidably mounted to a socket brace;

said socket cover including a channel that carries a cam shaft; and a drive plate mounted directly to said socket cover in a recessed area in said socket cover, said cam shaft extending through said socket cover and said drive plate and being rotatable across a range of motion; and said drive plate and said socket cover having range limit elements that engage one another to limit opposite ends of said range of motion.

12. The electrical socket assembly of claim 11, wherein said range limit elements include a tab formed perpendicularly with said drive plate, said drive plate being press fitted in said recessed area on a first side of said socket cover such that said tab extends through a slot inside said socket cover.

13. The electrical socket assembly of claim 11, wherein when said cam shaft rotates within said channel, said range limit elements including tabs in said drive plate on opposite sides of said channel, said cam shaft including a stop located such that when said stop engages one of said tabs, said socket cover is in an unlocked position and when said stops engages another of said tabs, said socket cover is in a locked position.

14. The electrical socket assembly of claim 11, wherein said cam shaft rotates within said channel in said cam portion, said range limit elements including a tab extending through a slot alongside a side wall of said channel such that said tab prevents said cam shaft from engaging said side wall.

15. The electrical socket assembly of claim 11, wherein said range limit elements include tabs located on said drive plate, said cam shaft engaging said tabs and imparting a force on said tabs, said force being distributed across said drive plate.

16. The electrical socket assembly of claim 11, wherein said drive plate further includes post holes that receive posts formed on said socket cover, said posts and post holes preventing said drive plate from moving relative to said socket cover.

17. The electrical socket assembly of claim 11, wherein said drive plate tightly fits into a recessed area in said socket cover.

18. The electrical socket assembly of claim 11, wherein said drive plate fits within a cam portion of said socket cover, said cam portion being formed integrally with said socket cover.

* * * * *